US005851685A

United States Patent [19]

McEldowney

[11] Patent Number: 5,851,685

[45] Date of Patent: Dec. 22, 1998

[54] RIVET IN A CONVERTED CAN END, METHOD OF MANUFACTURE, AND TOOLING

[75] Inventor: Carl McEldowney, Russia, Ohio

[73] Assignee: Aluminum Company of America, Pittsburgh, Pa.

[21] Appl. No.: 747,101

[22] Filed: Nov. 8, 1996

Related U.S. Application Data

[63] Continuation of Ser. No. 336,459, Nov. 9, 1994, abandoned.

[51] Int. Cl.[6] ..... B21C 37/00; B65D 17/34

[52] U.S. Cl. ..... 428/573; 428/577; 428/600; 220/269; 220/270; 220/272; 220/273

[58] Field of Search ..... 220/269, 273, 220/270, 272, 906; 428/600, 577, 573; 413/11, 12, 16

[56] References Cited

U.S. PATENT DOCUMENTS

| | | | |
|---|---|---|---|
| 4,465,204 | 8/1984 | Kaminski et al. | 220/269 |
| 4,530,631 | 7/1985 | Kaminski et al. | 413/12 |
| 4,610,156 | 9/1986 | Kaminski et al. | 72/431 |
| 4,678,096 | 7/1987 | LaBarge et al. | 220/273 |

*Primary Examiner*—Paul Thibodeau
*Assistant Examiner*—Holly C Rickman
*Attorney, Agent, or Firm*—Thomas R. Trempus

[57] ABSTRACT

An easy open can end having an improved rivet structure integrally formed thereon for the attachment of a pull tab, a method of further forming a can end to incorporate the improved rivet, and tooling for accomplishing the method. The further formation of the can end includes the steps of bubble formation, first button formation, and final rivet formation.

8 Claims, 9 Drawing Sheets

RIVET IN A CONVERTED CAN END, METHOD OF MANUFACTURE, AND TOOLING

This application is a continuation of application Ser. No. 08/336,459 filed Nov. 9, 1994, now abandoned.

BACKGROUND OF THE INVENTION

1. Field of the Invention

The present invention relates to easy-open ends for product containers, particularly, beverage and beer cans. In particular, the present invention provides an improved method for forming easy-open ends, improved tooling, and an improved can end.

2. Prior Art

Many metallic cans for holding beverages or other products are provided with easy-open can ends, wherein a pull tab attached to a tear strip that is defined by a score line in the can end may be pulled to provide an opening in the can end for dispensing the can's contents. For ecological and safety reasons, many regions require that the tear strip and attached pull tab be retained to the can end after opening. In order to meet these requirements, various designs have been suggested by the prior art for ensuring that the tear strip and pull tab do not become separated from the can end. Generally, the pull tab is retained to the can end by means of a rivet. Methods of rivet development utilizing the prior art can be found in U.S. Pat. Nos. 4,465,204 and 4,530,631 both to Kaminski et al., and assigned to the assignee of the instant invention. These patents are incorporated herein by reference as if fully set forth.

In the manufacture of an easy-open can end, a can end shell is first formed from a metal sheet product, preferably an aluminum sheet product. The can end shell is then conveyed to a conversion press. In the typical operation of a conversion press, a can end shell is introduced between an upper tool member and a lower tool member which are in the open, spaced apart position. A press ram advances the upper tool member toward the lower tool member in order to perform any of a variety of tooling operations such as rivet forming, paneling, scoring, embossing, tab securing, and final staking. After performing a tooling operation, the press ram retracts until the upper tool member and lower tool member are once again in the open, spaced apart position. The partially converted shell is transported to the next successive tooling operation until an easy-open can end is completely formed and discharged from the press. As one shell leaves a given tooling operation, another shell is introduced to the vacated operation, thus continuously repeating the entire easy-open can end manufacturing process.

The sheet product from which can end shells are produced is provided with a special coating during the manufacture of the sheet product. The preferred method for coating can end stock is E-Coating due to its lower cost and higher application speeds. It is, for example, much more efficient than the conventional method of roll-coating. The E-Coating serves several purposes including ensuring that the so-called "aluminum taste" that can be experienced in consuming a product contained in an aluminum container is substantially if not completely eliminated. The E-Coating is particularly resilient. It can withstand to an exceptionally satisfactory degree the extensive forming and reforming that occurs during the manufacture of a converted can end from an aluminum sheet product. Nonetheless, a converted can end may occasionally experience metal exposure caused by damage to the E-Coating, typically in the region of the rivet, the score, and the countersink radius. By knowing the magnitude of the strains that develop in the can end during the conversion process, the performance requirements of the internal coating can be anticipated. It is generally assumed that the strains seen by the coating are comparable to those seen by the surface of the metal onto which the coating has been applied.

Rivet formation is a particularly difficult aspect of the can end conversion process. As suggested above, rivet formation is a potential problem area for damage to the coating that can result in metal exposure. The rivet of a can end is integral to the shell, being made from metal in the shell's central panel. Typically, in a conversion press, the rivet is formed in progressive steps. A first station forms a bubble, a second and third station reform the bubble into a rivet, and finally after a tab is placed over the rivet, a staking station mechanically secures the tab to the rivet by flattening the protruding portion of the rivet over the tab. As can be appreciated, the very nature of rivet formation during the conversion process produces various strains in the surface of the metal with resulting strains in the surface coating applied to the surface of the metal.

Additionally, as the can end manufacturing industry strives to reduce costs by developing an increasingly lightweighted can end through both reduced diameter and reduced metal gauge, rivet formation becomes even more critical. Conventional rivet formation practices and tooling can tend to damage the coating on the can end shell and even tear the metal itself resulting in fractures and leaks in the converted can end. In order to avoid the physical damage of metal tearing proximate the rivet during conversion, it has been the practice to maintain the metal gauge of the can end to a minimum gauge of approximately 0.0108 to 0.0116 inch. It is an objection of the industry to continue to strive toward the manufacture of can ends of both reduced diameter and reduced metal thickness in order to effect enhanced cost savings through the use of less metal in each packaged product.

It is an object of this invention to provide a converted can end of a reduced gauge with an integral rivet having highly desirable characteristics.

It is another object of the present invention to provide a method of forming the rivet in a can end so as to eliminate damage to the coating of the metal from which the can end shell and the converted can end is formed.

It is another object of this invention to provide a converted can end and a method for manufacturing the same.

It is still another object of this invention to provide the tooling stations for the formation of an improved converted can end.

It is yet another object of this invention to provide a method and apparatus for forming an improved rivet in a converted can end whereby the gauge of the metal from which the end is formed can be reduced.

SUMMARY OF THE INVENTION

The invention provides an easy open can end having a rivet means integrally formed thereon for the attachment of a pull tab onto the can end. The improvement is the rivet structure, the tooling to form the rivet, and the method for further forming a can end. The formation of the rivet requires several operations. The first is the bubble formation in which the panel is at least partially formed into a bubble having a rounded cone-shaped head and a truncated base portion. The tooling is adapted to cold work the panel metal from which the bubble is formed into a predetermined thickness that varies along a portion of the bubble's height from the panel. The bubble is further formed by two additional steps that define a rivet for the attachment of a pull tab. The finally formed rivet is of a thickness that controls the flow of metal in the formation of the rivet head during the stacking of the tab.

The method is the further forming a can end having a central panel portion. The method steps include forming an integral bubble in the panel portion. The bubble has a rounded cone-shaped head and a truncated base portion, or coined band, adjacent the panel. The bubble is cold worked to be of a predetermined thickness and further formed to define a button having in part a shank portion for a rivet. The button is further formed by a second button formation step to configure the rivet by defining the shank portion so as to have a predetermined diameter selected to receive thereon a pull tab.

Tooling for the conversion of a can end shell into an easy open can end comprises several separate stations that are adapted for incorporation into a complete tooling set for a can end conversion press. One station forms an integral bubble in a panel portion of the can end shell. The panel portion is of a predetermined thickness and has a beverage side and a consumer side. The bubble station includes upper tooling and lower tooling. The lower tooling has a rounded head adapted to contact and support the beverage side of the panel portion. The upper tooling has a hollow die member defining a central longitudinal orifice adapted to cooperate with the rounded head. The upper and lower tooling cooperate to cold work or coin the integral bubble. The tooling in two additional stations further forms the integral bubble into a first button and then further forms the first button into a second button, or final rivet, onto which a pull tab can be inserted. The lower tooling of the first and second button formation stations are configured to cooperate so as to minimize the flow of metal from the top of the button in order to avoid the thinning of the top of the button.

DESCRIPTION OF THE DRAWINGS

The above as well as other features and advantages of the present invention can be appreciated through consideration of detailed description of the invention in conjunction with the several drawings in which.

DETAILED DESCRIPTION OF THE PREFERRED EMBODIMENT

Figure 1A:
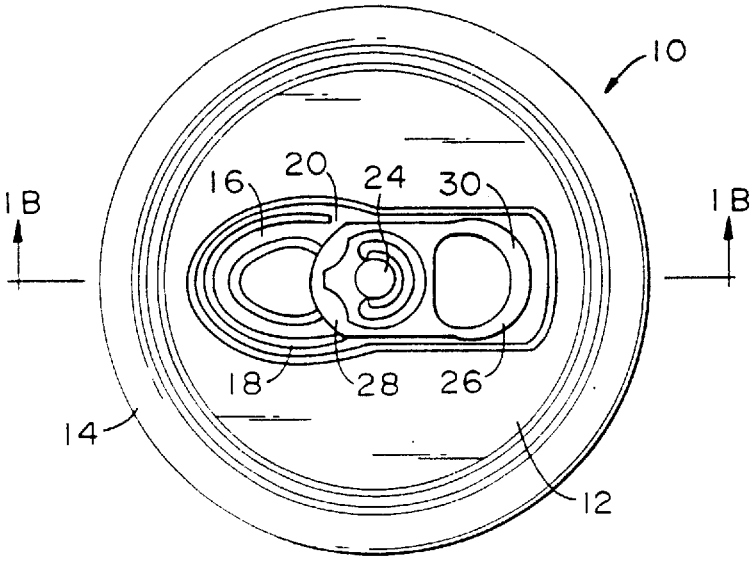
FIG. 1A is a top plan view of the improved easy-open can end incorporating the features of the present invention.
Figure 1B:
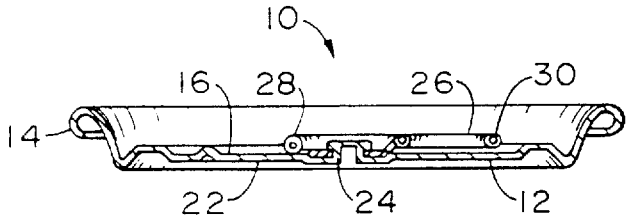
FIG. 1B is a cross sectional side view along lines 1B—1B of FIG. 1A.

A converted can end incorporating the features of the present invention is designated by reference character 10 in FIGS. 1A and 1B. Can end 10 has an end panel 12 of generally circular shape which includes a circumferentially extending raised edge 14 for attaching the can end 10 to a suitable cylindrical beverage can (not shown) or the like. In general, the can end 10 will be manufactured of a relatively ductile metal such as for example aluminum, but it may be made from other acceptable materials as required.

A retained tear strip 16 extends across can end 10 from a position spaced inwardly of raised edge 14 to approximately the center of can end 10. Tear strip 16 is defined by a generally U-shaped score line 18 with open end 20 of the U positioned toward the center of can end 10. A score line 18 is interrupted so that tear strip 16 will be captively retained on the underside or product side, 22 of can end 10 when torn open.

An integral rivet 24 is positioned adjacent open end 20 of U-shaped score line 18, and a graspable ring-like pull tab 26 which may be of any desired size and configuration is secured to can end 10 by means of rivet 24. Pull tab 26 is provided with a nose portion 28 to initiate the tear along score line 18 upon lifting of pull tab 26 whereupon tear strip 16 is torn open as is well known in the art. As can be seen, pull tab 26 is provided with a finger portion 30 opposite the nose portion 28.

Figure 2:
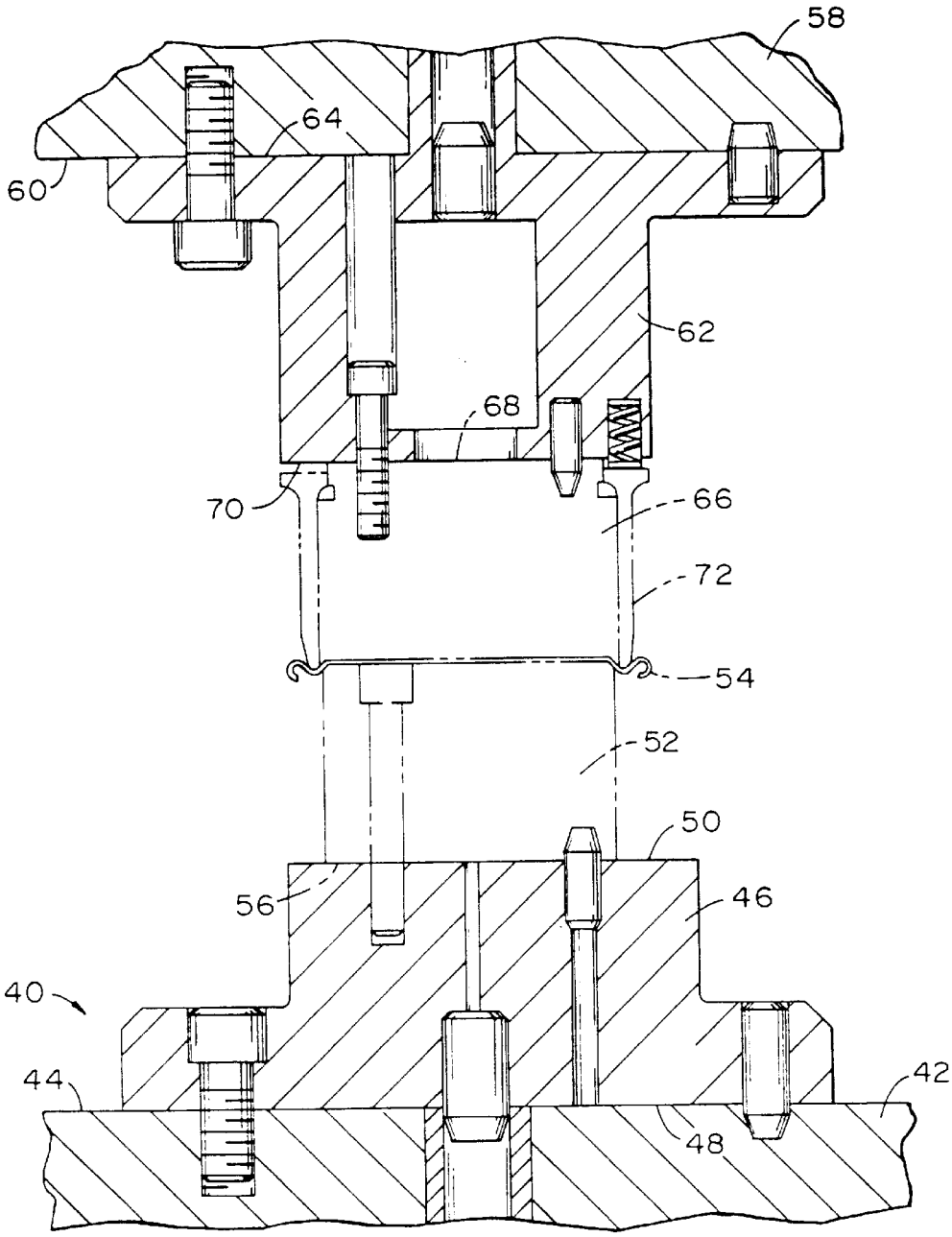
FIG. 2 is a cross sectional side view illustrating the press ram, tool support means, ram, upper and lower tool members, a support base and a stationary press bed.

The manufacture of a can end shell into an easy-open can end takes place in a conversion press, a portion of which is shown in FIG. 2. The Minster Machine Company of Minster, Ohio manufactures and sells an industrial press suitable for configuration as a can end conversion press. The conversion press 40 generally include a stationary press bed 42 including a generally planar horizontal upper surface 44. The upper surface supports a tooling base 46 which has a planar bottom surface 48 and a planar upper surface 50. Positioned upon the upper surface of tooling base is a lower tooling member 52 (shown in phantom) which make take a variety of shapes depending upon the tooling operation to be performed on the can end shell 54. However, each lower tooling member 52 has a planar bottom surface 56 which mates with the upper surface 50 of the tooling base 46 to provide secure support for the lower tooling member 52.

A vertically displaceable press ram 58 overlies press bed and includes a generally planar horizontal lower surface 60. This surface 60 of the press ram 58 supports a tool support means 62 which may take a plurality of shapes depending upon the type selected for a particular tooling operation. In general, however, the tooling support means or base 62 includes an upper planar surface 64 which provides solid mating contact with the surface 60 of the press ram 58 so that the tooling support means 62 is securely fastened to the press ram. The tool support means 62 securely supports an upper tooling member (shown in phantom) 66 having an upper planar surface 68 that is in mating contact with the lower planar surface 70 of the tool support means 62. The upper tooling member 66 can be one of many shapes and sizes depending upon the particular tooling operation to be performed. Typically, a centering ring 72 locates the can end shell 54 in each tooling station. The various types of tooling operations to be performed in succession include: bubble forming in the center of the open can lid, forming the bubble into a button; scoring an opening; paneling the can end in an area surrounding the scored opening; staking the pull tab to the can end; and stamping incise lettering upon the can end for messages such as "lift up, pull back" or "dispose of properly". U.S. Pat. No. 4,610,156, which is assigned to the assignee of the instant invention, sets forth a detailed description of the various tooling stations of a conversion press. The contents of this patent are incorporated herein by reference as if fully set forth. The can end conversion process may require from six to eight stations in which differently configured tooling carries out successive cold-working of the metal in the several steps in the conversion of a can end shell in an easy-open can end.

The instant invention is directed particularly to an improved method of rivet formation, the tooling for this rivet formation, and an easy-open can with the improved rivet. Accordingly, the several steps in a can end conversion process by which the rivet is formed and the tab staked to the can end will be described in detail. It is to be appreciated that the while the invention is described in conjunction with a stay-on-tab can end, this invention can be used on a tear-away-tab can end.

Figure 3A:
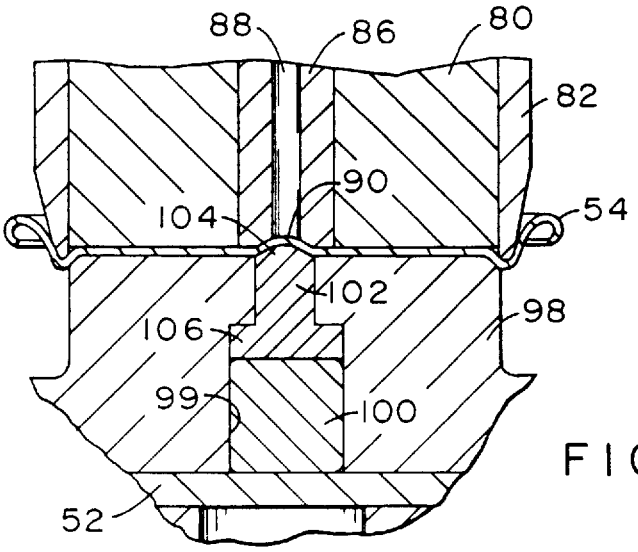
FIG. 3A is a cross sectional side view of the easy-open can end illustrating the upper and lower tooling members for forming a centrally located bubble in the easy-open can end.

FIG. 3A illustrates the first operation performed on the easy-open can end (illustrated in FIG. 1) that directly pertains to rivet formation. The tool support means 52, mounted upon the stationary press bed (shown in FIG. 2) supports a lower tooling member 98. The central area 99 of the lower tooling member 98, includes an insert adjustment spacer 100 which supports the punch, or lower bubble insert, 102. The punch 102 has a generally rounded head 104 which contacts the metallic easy-open can end 54 and a flanged area 106 which rests upon the insert adjustment spacer 100. As the rounded head 104 of the punch wears out, a larger insert adjustment spacer 100 may be necessary. Additionally, the depth of penetration of the punch, i.e., the height of the bubble, is also determined by the insert adjustment spacer 100.

The upper tooling member 80 is surrounded by a centering ring 82 which acts to center the easy-open can end 54 so that the so-called "bubble forming" or "rivet preform" operation may be completed in the desired location, typically the center, of the can end panel. The upper tooling member 80 is supported by and suspended from the press ram (FIG. 2) by a plurality of bolts and studs. The upper tooling member 80 includes a hollow die member, or upper bubble insert, 86 having a central longitudinal orifice 88. The die 86 aids in forming the bubble 90 on the panel.

Figure 3B:
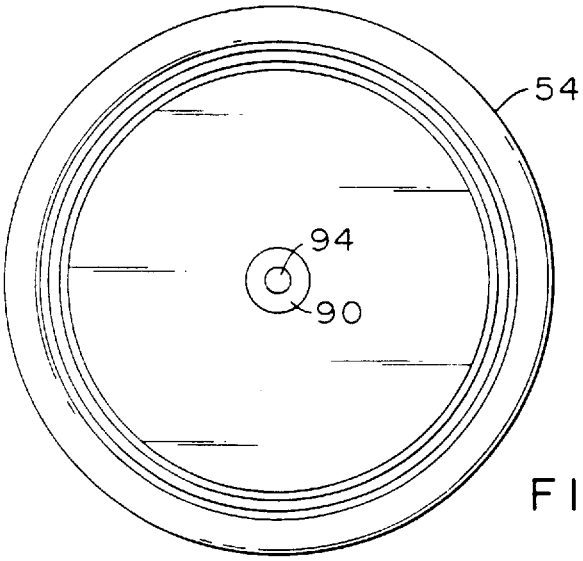
FIG. 3B is a plan view illustrating the easy-open can end having a bubble centrally located thereon.
Figure 3C:
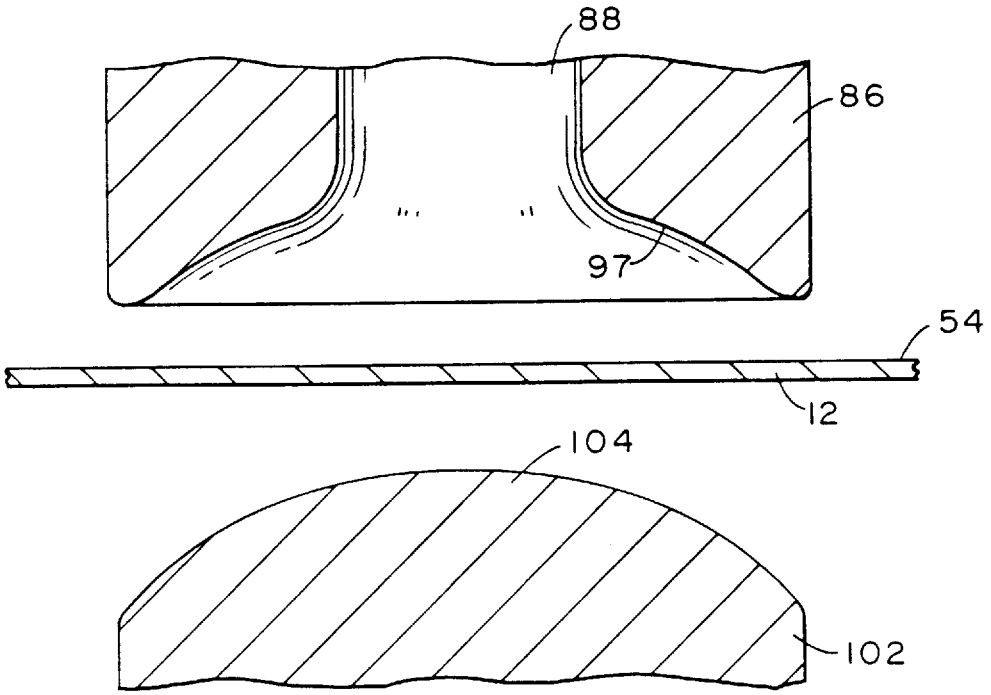
FIG. 3C is a cross-sectional detail view of the easy-open can end illustrating the bubble formed tooling in an open position relative to the can end panel.
Figure 3D:
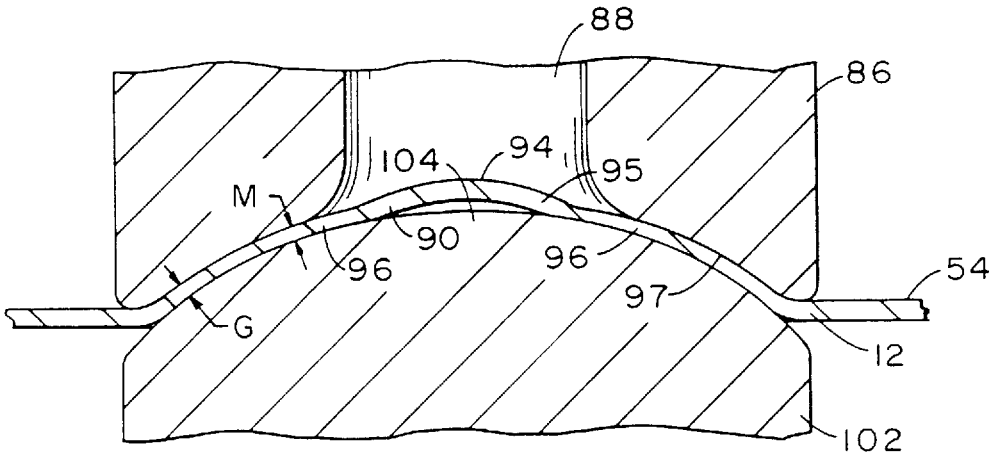
FIG. 3D is a cross-sectional side view of the upper and lower tooling members forming the centrally located bubble in the easy-open can end.

The moving of sufficient metal into the bubble from the end panel so that a rivet can be formed in subsequent operations is the first challenge encountered during rivet formation. Preferably, the bubble has sufficient metal so that ultimately, the rivet residual thickness is sufficient to form the rivet hat or the flattened portion that physically retains the tab onto the rivet. Also, it is necessary to keep the bubble from being so thin as to cause the base of the bubble or rivet island to be susceptible to tearing. It has been the conventional practice during bubble formation to coin the metal on the can end panel proximate the base of the bubble, that is, the portion of the panel where the newly formed bubble extends from the upper surface of the panel. Contrary to the existing practice, according to the present invention, coining occurs proximate the upper portion of the bubble. As shown in FIGS. 3C and 3D, a coin band is formed between the head 94 of the bubble and the panel. This structure of the bubble minimizes stretching of the metal from which the bubble is formed, thus minimizing the possibility of damage to the coating. Coining is, simply stated, the work hardening of metal between tools. The metal being so worked typically is compressed or squeezed between a set of tools, usually, between an upper and lower tool.

In the first operation of the bubble tooling procedure, a can end shell is worked by the tooling illustrated in FIG. 3A. A rivet preform or bubble 90, is formed from the metal of the central flat surface panel portion of the easy-open can end, as shown in FIGS. 3B, 3C, and 3D. Coining of the bubble side wall takes place during formation. The formed bubble 90, more clearly shown in FIG. 3D, consists of a rounded cone-shaped head 94, and a truncated base portion, or coined band, 96 whose side tapers upwardly at a lesser slope than the side wall 95 of the cone head 94 of the bubble 90. In order to provide the desired coining of the bubble, the lower tooling punch or lower insert 102 has a generally rounded head 104 which contacts and supports the bottom or beverage side of the panel. The upper tooling member 80 includes a hollow die member or upper bubble insert 86 having a central longitudinal orifice 88. The upper insert 86 has a coining tool face 97 that cooperates with the lower insert 102 to cause the controlled coining of the bubble. The bubble is coined in an amount consistent with the clearance between the upper and lower inserts, 86 and 102 respectively, as the ram advances into its lower most position relative to the press bed. In FIG. 3D, the clearance is at a minimum value "M" proximate the top of the cone-shaped bubble and greatest in value "G" distal the top of the cone-shaped bubble. In other words, a slightly greater degree of coining takes place at the upper portion of the coined band, the portion distal the can end panel. By initiating the coining at a location that is ultimately adjacent the rounded head of the bubble, the cold work thinning or stretching of the head of the rivet is minimized, if not substantially eliminated. Preferably, the clearance at the minimum value is approximately 0.0068 inch, while the clearance at the maximum value is approximately 0.0005 inch greater than the minimum value. The compound radius of either, or both, the lower and upper inserts can be controlled to arrive at the necessary clearance to provide the desired coining.

In a second tooling operation, the bubble formed in the operation shown in FIG. 3A is formed into what typically is referred to in the can making industry as a button or a rivet. The bubble, reformed into a first button, now has a clearly visible "shank" portion of the final rivet. Conventional, prior art practice coins the panel at the base of the rivet in order to raise by cold working the button to a desired height relative to the can end panel.

Figure 4A:
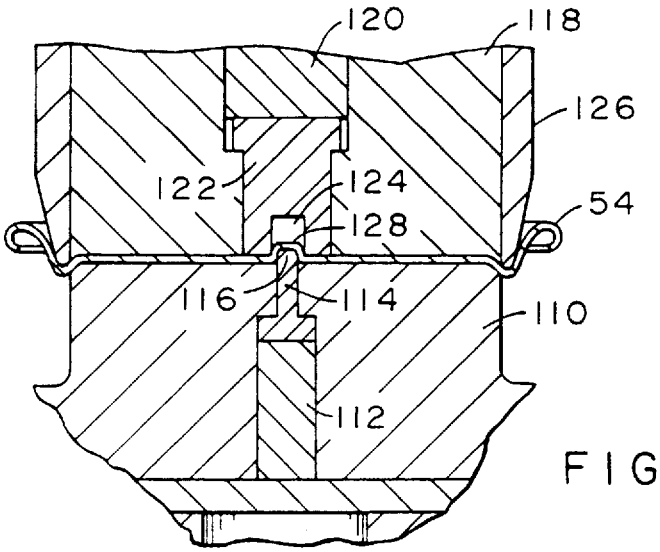
FIG. 4A is a cross sectional side view of the easy-open can end illustrating the upper and lower tooling members for forming a first button from the centrally located bubble in the easy-open can end.
Figure 4B:
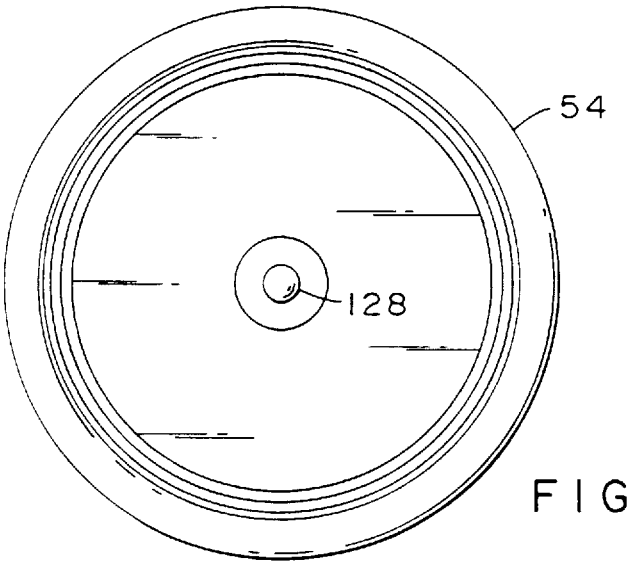
FIG. 4B is a plan view illustrating the easy-open can end having a first button formed thereon.

As illustrated in FIG. 4A, according to the instant invention, the lower tooling member 110 includes an insert adjustment spacer 112 and a punch 114 having a rounded head 116. The punch or first button formation lower insert 114 is smaller in diameter than the bottom punch 102 used in bubble formation (FIG. 3A). The upper tooling member 118 has an upper button adjustment spacer 120 and a circular die or first button formation upper insert 122 having a central recess portion 124 which is narrower in diameter than the "diameter" of the bubble 90. The lower insert 114 has a generally flat upper portion 117 that serves to minimize cold work stretching of the head 94 of the bubble. As a result, the head of the rivet as finally formed in a subsequent station retains more metal because it is subjected to less cold working. Consequently, the coating on the beverage side of the rivet is subjected to less stress. The upper tooling 122 has a radius of curvature that is selected to initiate the formation of the rivet shank, while at the same time minimizing stress induced damage to the portion of the rivet shank proximate the panel. This protects the coating in this location in the same fashion as described above in conjunction with the rivet head.

Figure 4C:
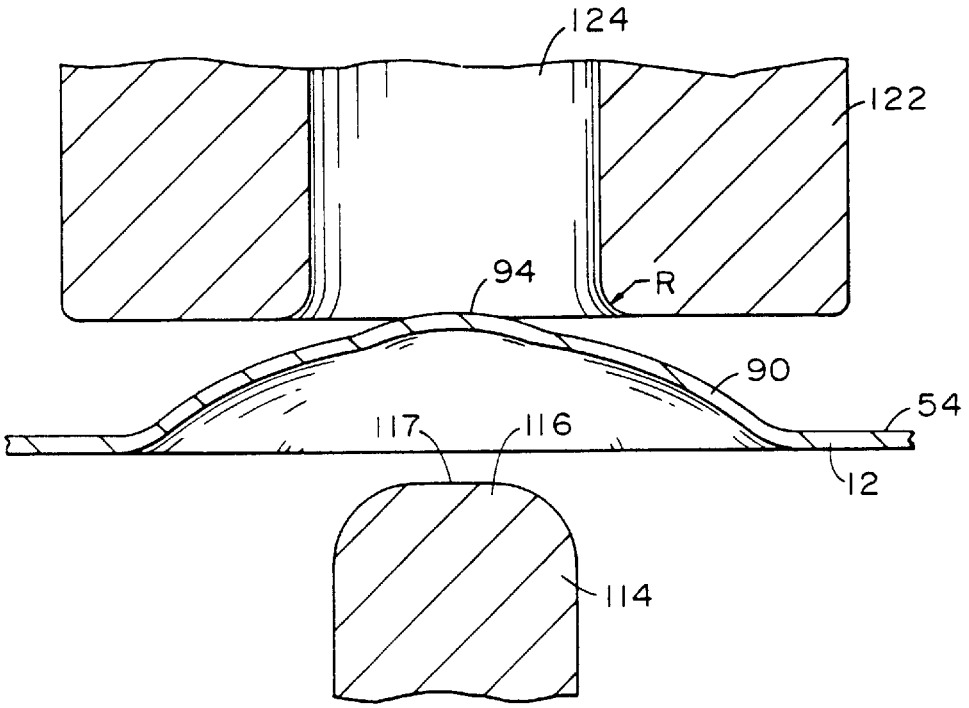
FIG. 4C is a cross-sectional detail view of the easy open can end first button tooling in an open position relative to the bubble formed in a can end panel.
Figure 4D:
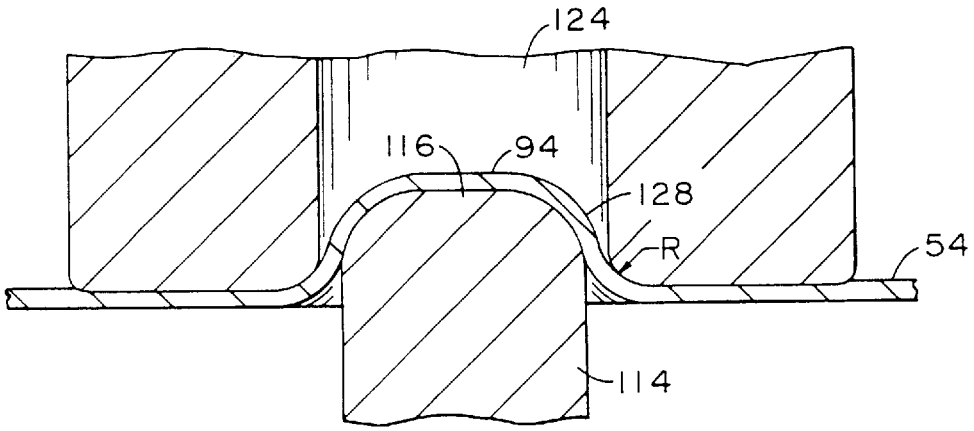
FIG. 4D is a cross-sectional side view of the upper and lower tooling members forming the first button or first rivet form from the bubble.

In operation, the button forming tooling converts or further forms a shell with a bubble 90 between the upper and lower tooling members 118 and 110. A centering ring 126 positions the shell on the tooling. The press ram forces the upper tooling member 118 down upon the shell 54, now supported by the lower tooling member 110. As the press advances toward the stationary press bed, the bubble 90 is reshaped or reformed into a button or rivet 128 as illustrated in FIGS. 4C and 4D. The size relationship between the lower punch 114 and the upper circular die recess portion 124 effect the flow of metal in the button. Applicant has devised a general relationship between these tooling components that causes their cooperation to effect in combination with the remaining tooling described herein an improved rivet for converted can end. Moreover, this tooling relationship concept functions with end stock of varying gauges so as to facilitate gauge reduction in can ends. The inside diameter of the central recess portion of the upper insert is selected in accordance with the desired final rivet dimensions. As will be appreciated by one skilled in the art of can making, the desired rivet dimension is in turn a function of, among other things, the stay-on-tap design selected and the dimension of the tab aperture. As can be seen in FIG. 4D, the lower punch diameter is selected to equal the diameter of the central recess portion of the upper insert minus two times the gauge of the end stock plus a constant for metal clearance of 0.002. For example, the ultimate desired diameter of the rivet is known according to the tab that is to be eventually staked on to it. If the die central recess portion 124 therefor has an inside diameter "ID" of 0.1508 inch, and the end stock has a thickness of 0.0108 inch, then the preferred lower punch diameter "LPD" can be calculated as follows:

$$LPD=[ID-(2\times End\ Stock+0.002)]$$

Additionally, in one embodiment of this invention, the upper insert is provided with a draw radius of approximately 0.019 degrees and the lower punch is provided with a draw radius of approximately 0.042 degrees. These dimensions are provided for illustrative purposes only so that an appreciation can be gained of the relationship between the tooling of the first button formation station and the second button formation station (third rivet tooling station) as described below. As will be appreciated in conjunction with the description below of the third tooling operation, the die central recess "ID" of the first rivet formation station may be greater than the final desired outside diameter of the rivet. The third rivet tooling station can be configured to carry out the final coldworking of the rivet to the desired diameter.

Figure 5A:
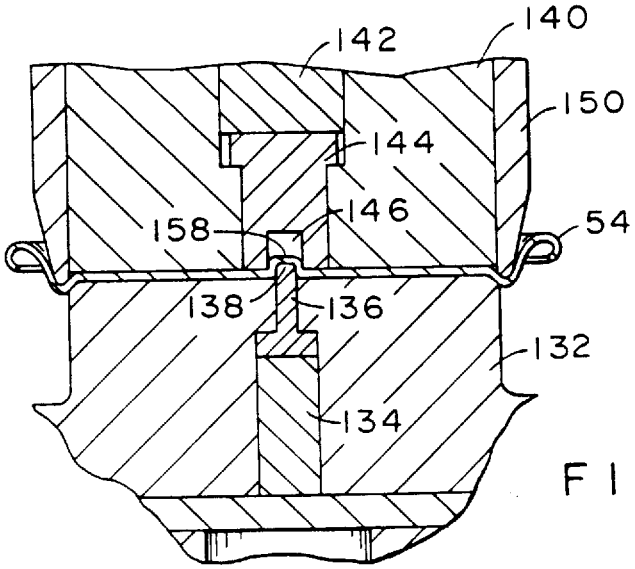
FIG. 5A is a cross sectional side view of the easy-open can end illustrating the upper and lower tooling members for forming a second button from the centrally located first button in the easy-open can end.
Figure 5B:
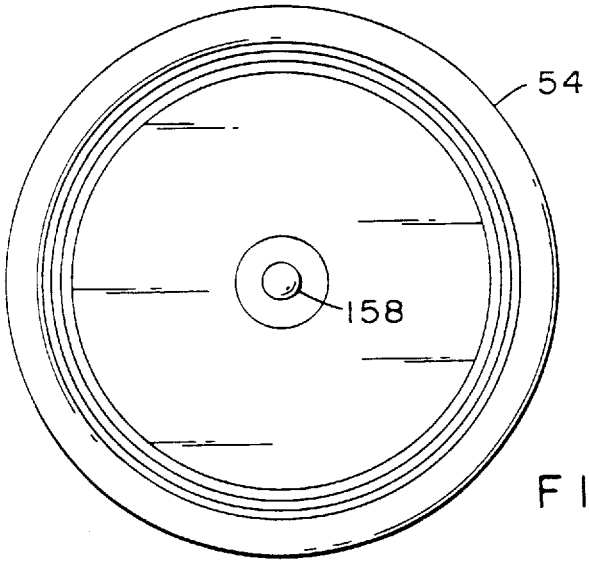
FIG. 5B is a plan view illustrating the easy-open can end having a second button formed thereon.
Figure 5C:
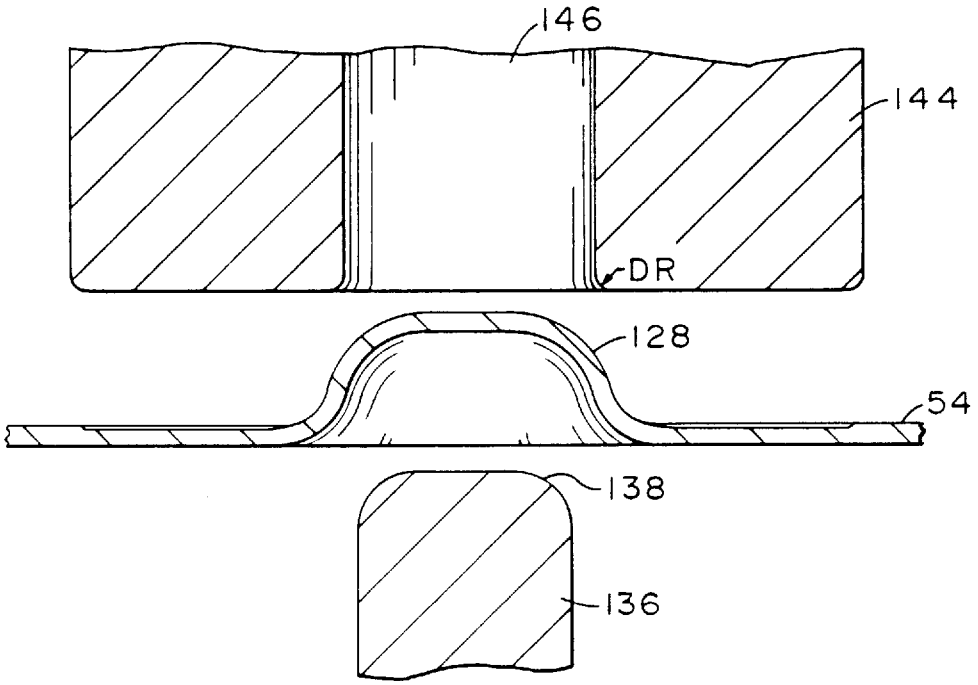
FIG. 5C is a cross-sectional side view of the easy-open can end illustrating the upper and lower tooling members for forming a second button or final rivet form from the centrally located first button (or first rivet form) in the easy open can end.
Figure 5D:
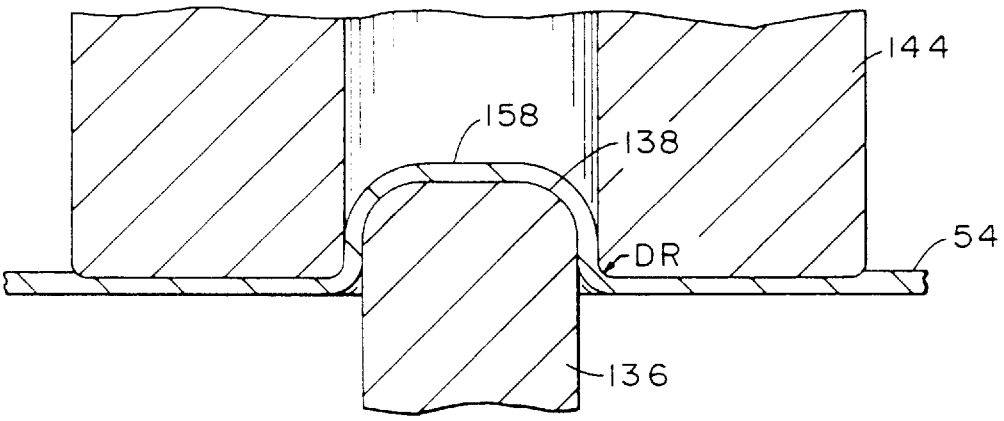
FIG. 5D is a cross-sectional side view of the upper and lower tooling members forming the second rivet from the first rivet.

A third tooling operation is illustrated in FIGS. 5A, 5C and 5D. Here, the first button is further formed into the "second button". The further forming or reforming in the second button formation step more clearly defines the shank of the rivet, placing the "button" in final condition for the staking of the tab. In this operation, a lower tooling member 132 shown in FIG. 5A includes an insert adjustment spacer 134 and a punch or second button lower insert 136 having a rounded head 138. The upper tooling member 140 has an upper button adjustment spacer 142 and a circular die 144 having a central recess portion 146 of a predetermined diameter selected to cooperate with the shank of the button as formed in the first button forming station.

In operation, the second button formation forming tooling converts or further forms a shell with a first button or rivet 128 formed therein into its final configuration prior to staking. The shell 54 is located between the upper and lower tooling members by means of a centering ring 150. The press ram forces the upper tooling member down upon the can end 54 which is supported on upon the lower tooling member 132. As the press advances toward the stationary press bed, the first button 128 is reshaped or reformed into the second button 158 as illustrated in FIGS. 5B and 5D. The draw radius "DR" of the lower face of the upper tooling is sharper than the draw radius "R" of the comparable tooling of the first button station. The sharper draw radius further cold works or forms the lower portion of the rivet proximate the panel into its final form in preparation for the staking of the tab onto the rivet.

This second button 158 (or fully formed rivet) is formed using tooling having an inside diameter that is slightly less than the inside diameter of the upper tool of the first button station. Similar to the concept described above, the preferred relationship between the lower punch diameter "LPD" and the upper insert inside diameter "ID" can be expressed in the following manner in which a constant, 0.954, for metal clearance of tooling relief is provided.

$$LPD=[ID-(2\times End\ Stock\times 0.954)]$$

In the embodiment of this invention described above, the upper insert is provided with a draw radius of approximately 0.0080 degrees (compared to 0.019 degrees in the first button station) and the lower punch is provided with a draw radius of approximately 0.032 degrees (compared to 0.042 degrees in the first button station). Alternatively, the draw radius of the lower punch can be the same in the lower tools of both the first and second button stations. The top of the lower punch is substantially flat in order to minimize metal displacement in the head of the rivet. In summary, by way of example, based upon the dimensions provided herein above, the first button lower punch has a diameter of 0.1272 inch and the second button lower punch has a diameter of 0.1098 inch.

Figure 6:
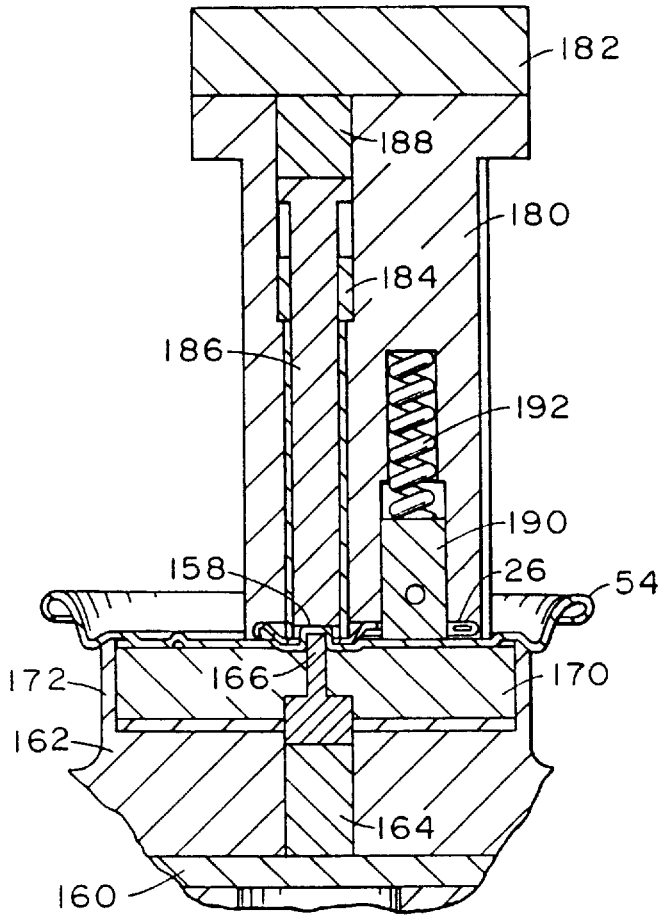
FIG. 6 is a cross sectional side view of the easy-open can end illustrating the upper and lower tooling members for staking a tab onto the second formed button in the easy-open can end.

FIG. 6 illustrates the tooling for the staking process and a staked can end. In the staking process, a pull tab is positioned within the panel portion of the can end so that the second button 158 or rivet projects through the rivet or pivot opening of the pull tab. The down stroke of the upper punch "squeezes" the top of the rivet between the upper staking punch and the lower staking anvil. This squeezing action thins the metal in the top of the rivet causing the radically outward movement of metal that 2 the rivet head, thus holding the pull tab in place. More particularly, in FIG. 6, a lower tooling member 162, that is supported by tooling member 162, includes an adjustment spacer 164, a small anvil 166 to prevent the rivet from being driven downwardly thorough the metallic easy-open can end 54, and a primary anvil 170. The primary anvil 170 provides support for the can end 54 in the area surrounding the rivet or button. Moreover, the lower tooling member 162 includes an integral, annular, peripheral support ring 172 which surrounds the primary anvil 170 and supports the periphery of the can end 54.

The upper tooling member 180 includes a solid spacer 182 at the upper end thereof. An adjustment spacer 184 is provided between the staking punch 186 and the primary adjustment spacer 188. The staking adjustment spacer 184 determines the degree to which the rivet is flattened or squeezed outwardly in order to retain the pull tab. Additionally, the upper tooling member is provided with a positioning dowel 190 which is designed to fit within the generally circular finger opening of the pull tab 26. The dowel 190 is spring loaded as at 192 so that it holds the pull tab 26 in position while the staking punch 186 flares the button rivet 158 outwardly. Typically, this operation does not include the use of a centering ring because the can end will be properly positioned once the button or rivet projects through the rivet hole of the pull tab and the position dowel securely positions the pull tab. The converted can end is shown in FIGS. 1A and 1B and discussed above.

In an alternative embodiment the lower tooling 114 and 136 can be of substantially the same dimensions. The upper tooling 122 and 124 would then each have a central recess portion 124 and 146, respectively, of substantially the same diameter. However, the draw radii of the tooling remains as described above, with the second rivet formation tooling having a sharper draw radius than the first rivet formation tooling.

A particular advantage gained by the rivet formation carried out according to the teachings of this invention occurs during staking. The head of the rivet is not subjected to the thinning that occurs during conventional rivet formation. As a result, more metal is available to form the flattened head of the rivet during staking. Thus the appearance of the final product is enhanced and its functionality is improved because of a more substantial and more uniform metal structure.

What is claimed is:

1. A rivet preform that is adapted to be further formed into a rivet that attaches a pull tab onto a panel of an easy open can end, said rivet preform comprising a panel which is at least partially formed into a bubble having a rounded cone-shaped head with integral side wall and a truncated base portion with integral side wall, said truncated based portion being disposed between said rounded cone-shaped head integral side wall and said panel portion and wherein said truncated base portion integral side wall tapers upwardly from said panel at a lesser slope than the upwardly tapered, rounded cone-head integral side wall, said rivet preform truncated base portion being coldworked to be of a predetermined thickness that varies along said truncated base portion integral side wall wherein said cold-worked rivet preform truncated base portion integral side wall is of a lesser thickness proximate said cone-shaped head than proximate the panel.

2. The rivet preform according to claim 1 wherein the truncated base portion integral side wall is of a lesser thickness proximate said cone-shaped head than proximate the panel such that the minimum difference therebetween is approximately 0.0005 inch.

3. The rivet preform according to claim 1 wherein the cone-shaped head is of generally uniform thickness.

4. The rivet preform according to claim 3 wherein the truncated base portion integral side wall is of a lesser thickness proximate said cone-shaped head than proximate the panel such that the minimum difference therebetween is approximately 0.0005 inch.

5. A rivet preform that is integral with a panel of an easy open can and that is adapted to be further formed into a rivet that attaches a pull tab onto said panel said rivet preform comprising a rounded cone-shaped head with integral side wall and a truncated base portion with integral side wall adjacent the panel, wherein said truncated base portion integral side wall tapers upwardly from said panel at a lesser slope than the upwardly tapered, rounded cone-head integral side wall, said rivet preform truncated base portion integral side wall being coldworked to be of a lesser thickness proximate the cone-shaped head than proximate the panel along the truncated base portion of the rivet.

6. The rivet preform according to claim 5 wherein the truncated base portion integral side wall is of a lesser thickness proximate said cone-shaped head than proximate the panel such that the minimum difference therebetween is approximately 0.0005 inch.

7. The rivet preform according to claim 5 wherein the cone-shaped head is of generally uniform thickness.

8. The rivet preform according to claim 7 wherein the truncated base portion integral side wall is of a lesser thickness proximate said cone-shaped head than proximate the panel such that the minimum difference therebetween is approximately 0.0005 inch.

* * * * *